United States Patent [19]

Kashiwara et al.

[11] Patent Number: 4,808,878

[45] Date of Patent: Feb. 28, 1989

[54] IGNITION PLUG FOR INTERNAL COMBUSTION ENGINES TO CAUSE INSTANT COMBUSTION

[76] Inventors: Takeaki Kashiwara, 411, 3-37 Nagayoshidado 3-chome, Hirano-ku, Osaka; Ryohei Kashiwara, Nishimura Bldg. Room No. 302,85-6, Ootori-Nishimachi-cho, Sakai; Hideaki Kashiwara, 3-Ba 611,151-30,Mukojima Ninomaru-cho, Fushimi-kuz, Kyoto, all of Japan

[21] Appl. No.: 877,755

[22] Filed: Jun. 24, 1986

[30] Foreign Application Priority Data

Jul. 3, 1985 [JP] Japan ..... 60-147042

[51] Int. Cl.[4] ..... H01T 13/20

[52] U.S. Cl. ..... 313/141; 313/142

[58] Field of Search ..... 313/141, 142, 143, 144, 313/138, 139

[56] References Cited

U.S. PATENT DOCUMENTS 1,360,294 11/1920 Hill ..... 313/139 X 2,616,407 11/1952 Thomas ..... 313/145

4,401,915 8/1983 Kashiwara et al. ..... 313/142

FOREIGN PATENT DOCUMENTS 2479588 10/1981 France ..... 313/139

53-54774 10/1976 Japan .

53-87331 12/1976 Japan .

53-25743 3/1978 Japan .

61-30394 7/1986 Japan .

*Primary Examiner*—David K. Moore

*Attorney, Agent, or Firm*—Fisher, Christen & Sabol

[57] ABSTRACT

An ignition plug has a casing with a center electrode disposed therein. Adjacent and mutually spaced from the center electrode is a grounded electrode which is connected to the casing with at least one stay. A gas hole is provided on the grounded electrode opposite from the center electrode. The stay(s) are configured to swirl explosion gases to increase combustion speed. There are several embodiments of the grounded electrode, wherein each is provided with a gas re-entrant cavity on the piston side of the gas hole, wherein the cavity is shape configured for the purpose of accelerating the propagation speed of combustion gas.

13 Claims, 5 Drawing Sheets

IGNITION PLUG FOR INTERNAL COMBUSTION ENGINES TO CAUSE INSTANT COMBUSTION

FIELD OF THE INVENTION

This invention relates to an ignition plug for internal combustion engines to cause instant combustion which can widely increase combustion speed and economize fuel cost; therefore, the ignition plug is favorably used for automobiles, trucks, buses and so forth.

DESCRIPTION OF THE PRIOR ART

As so far disclosed in Japanese patent application No. sho 53-121107, U.S. Pat. No. 4,401,915 and others, conventional ignition plugs provided with a center electrode and an opposed grounded electrode commonly have one or more than one tapered gas holes on the grounded electrode in order to converge and accelerate the flow of combustion gas from the spark side to the piston side.

Certainly, the prior art has had an advantage in its own way. However, in those ignition plugs a gas collector is provided by bending the longitudinal ends of a flat grounded electrode; hence, the gas combustion speed is different in the longitudinal and the lateral directions of the grounded electrode. Moreover, it is difficult to determine the size of the gas holes, the inclination and the broadness of slopes on both sides of the gas collector. In addition to that, there is a limit per se in creating stronger turbulence and higher combustion speed in correspondence to the exhaustion capacity of cylinders.

SUMMARY OF THE INVENTION

Accordingly, the present inventor made intensive studies to eliminate the above drawbacks and limit and finally accomplished this invention. That is, this invention concerns an ignition plug for internal combustion engines to cause instant combustion, comprising: a hollow grounded electrode having a truncated conical form with a top at a narrow end and a bottom at a wider end, wherein said top is disposed face to face with a center electrode in such a way that the electrodes' respective axis falls in the same line and the spark gap lies between the top of said center electrode and the top of said grounded electrode, and wherein said bottom is disposed towards a piston.

It is an object of this invention to provide an ignition plug for internal combustion engines that causes instant combustion with increased and uniform combustion speed in the combustion chamber. It is another object of this invention to provide an ignition plug for internal combustion engines that has a very simple structure to cut down on the production cost and still widely economize the fuel cost.

The above and other objects and features of this invention will appear more fully hereinafter from a consideration of the following description taken in connection with the accompanying drawing wherein examples are illustrated by way of example.

DETAILED DESCRIPTION OF THE INVENTION

This invention will be described in detail by way of examples in reference to the accompanying drawing.

Figure 1:
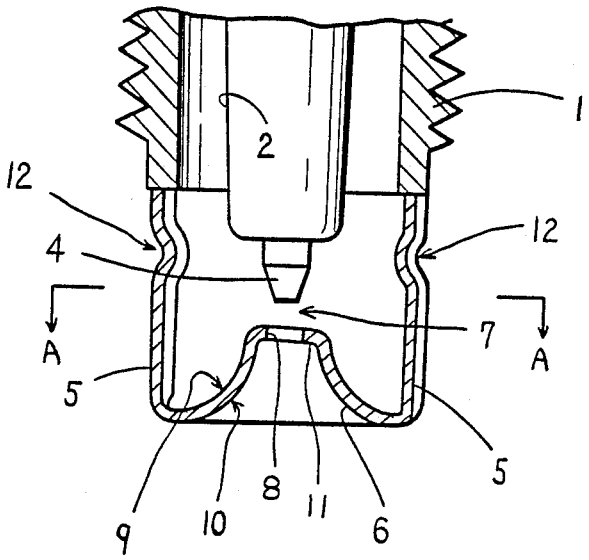
FIG. 1 is a cross-sectional side view of an essential part of an ignition plug of this invention.
Figure 3:
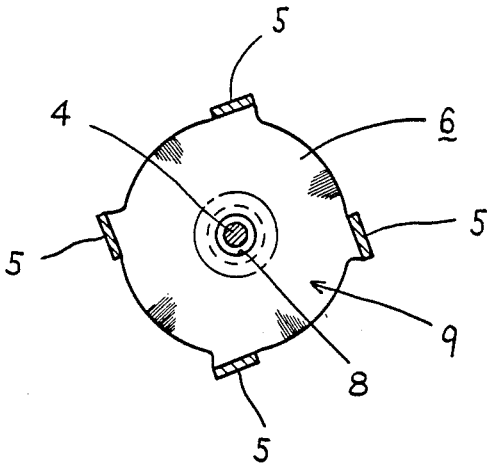
FIG. 3 is a cross-sectional plan view taken in the line A—A in FIG. 1 which is given to show the arrangement of stays for connecting a grounded electrode to a casing of a center electrode.
Figure 2:
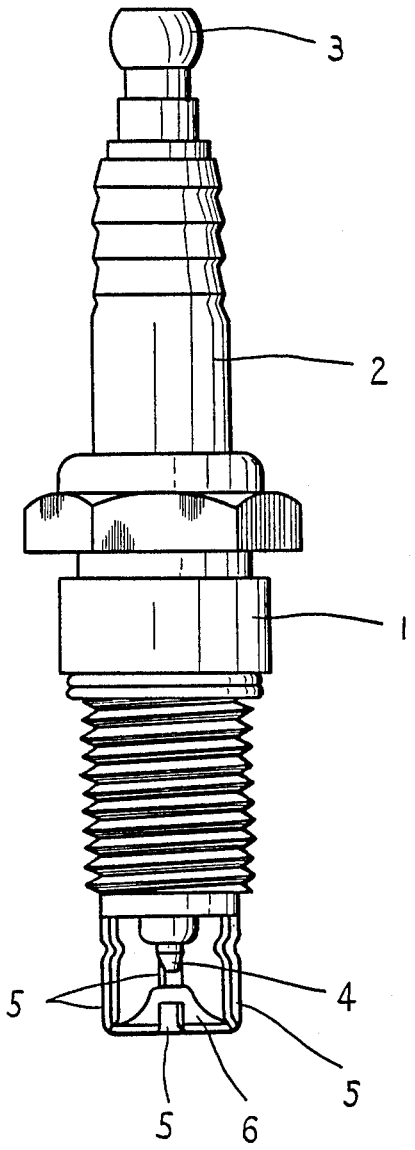
FIG. 2 is an entire view of the same ignition plug as the above.

In FIGS. 1 to 3, the numeral 1 denotes an electroconductive metal casing secured with its screw to an internal combustion engine block and the numeral 2 denotes an insulating gasket made of ceramic, porcelain or the like whose end is provided with a terminal 3. A center electrode 4 is firmly supported by the insulating gasket 2 and a grounded electrode 6 is fixed to the top of the metal casing 1 by means of a holder 5. The grounded electrode 6, shaped into a truncated conical form, is faced to the center electrode 4 so that their respective central axis falls on the same line, whereby spark gap 7 forms between the top of the center electrode 4 and the top of the grounded electrode 6. More particularly, it might as well be described that the grounded electrode is more alike an inverted trumpet with steep surface around the top and gentle surface around the bottom. The shape of the grounded electrode being such that an interior concave surface 9 faces to the spark side and an exterior convex surface 10 faces to the piston side.

A hole 8 for introducing fuel-air mixture in the interior space on the spark side is provided on the top of the grounded electrode. (Hereinafter fuel-air mixture is simply referred to as gas mixture.) A gas-collecting re-entrant cavity 11 forms outside the gas holes 8 almost perpendicular to the exterior convex surface on the piston side.

Four stays 5 of the holder which are disposed apart from each other at right angles are all flat and twisted by a certain angle toward the same direction. Namely, the surface of the stays are inclined so as to face an ignition point between the center electrode 4 and the gas hole 8 in such a way that exploding gas with increasing volume gets out of the interstice between the stays in a swirling manner in a moment, whereby combustion gas is helped to make a strong turbulence and increase the combustion speed; therefore, there can be formed uniform gas combustion.

The outer top diameter of the grounded electrode 6 is made almost equal in size to the diameter of the electroconductive metal casing end 1. A middle portion on the stays 5 is inwardly buckled 12 toward the center electrode 4 in such a way that the spark gap 7, i.e. the distance between the gas hole 8 and the top of the center electrode can be adjusted by adjusting the height of the stays with the parallelism of the top of the center electrode and the top of the grounded electrode left unchanged.

The top of the center electrode 4, whose center is in alignment with the center of the grounded electrode 6 through which the gas hole 8 is pierced, is smaller than the gas hole and resembles it in shape; therefore, spark is formed in a cylindrical form between the periphery of the center electrode 4 and the brim of the gas hole 8. Because spark is always formed like this in the scope of the gas hole, the gas ignition and combustion are made the nearest possible to the gas hole on the piston side.

The first example of this invention being constructed such that when electric current is applied to the terminal 3, there forms spark in the spark gap 7 between the center electrode and the grounded electrode. Therefore, when gas mixture compressed by a piston up to the top dead center is passed through the gas hole 8, the gas mixture ignites by the spark and explodes, by which the piston is moved back.

Space surrounded by the exterior steep surface of the trumpet-shaped grounded electrode is so narrow for the exploding gas mixture that its explosion increases the inside pressure with the greatest rate of expansion, hindered by the wall of the space on the piston side 10. The increased pressure accelerates the propagation speed of combustion gas with which the combustion travels over the exterior gentle surface of the grounded electrode.

The gas mixture on the interior concave surface 9 also ignites, expands and generates high pressure hindered by the surrounding surface, which causes strong turbulence there. The turbulence of the combustion gas becomes much more swirled when passing through the stays of the holder 5, which also gives the gas mixture remaining inside the combustion chamber a desirable effect for instant combustion. Namely, in internal engines, the instant combustion of gas mixture inside the combustion chamber directly results in the power increase and economize the fuel cost; and the turbulence of gas mixture is one of the most indispensable factors in giving instant combustion.

As best seen from the above description, it is to be noted that the function of the interior concave surface 9 and the exterior convex surface, provided on the spark side and the piston side respectively, can well satisfy the requirement for every kind of ignition plugs. Particularly, in comparison with those of the prior art, it is one of the major characteristics of this invention that combustion gas can uniformly spread out in the combustion chamber with the aid of the interior concave surface 9 and the exterior convex surface 10 so as to facilitate instant combustion.

Figure 4:
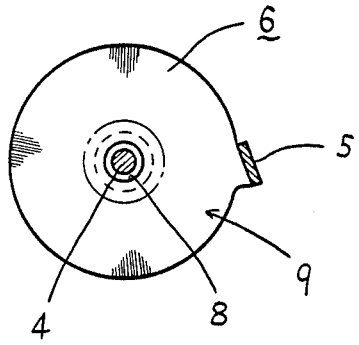
FIGS. 4, 5 and 6 are illustrations showing cross-sectional views of the stay/stays in a few modified arrangements.
Figure 5:
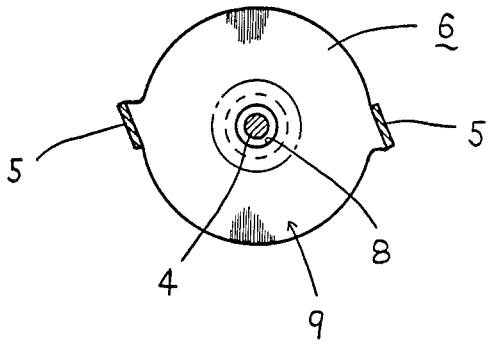
Figure 6:
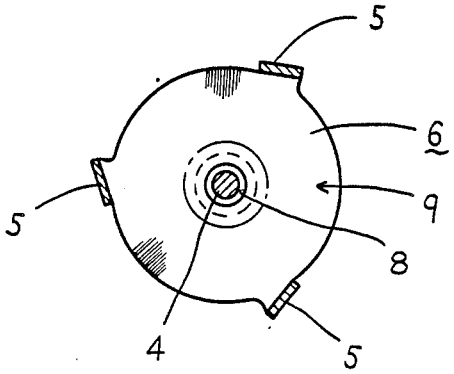

Referring now to FIGS. 4 to 6, a few examples of the way of arranging the stay/stays in an ignition plug of this invention will be described as follows: As shown in FIG. 4, according to this invention, it is possible to support a grounded electrode 6 with a single-stayed holder 5 in order to improve the diffusion rate of combustion gas on the spark side.

As shown in FIG. 5, it is also possible to support a grounded electrode 6 with a double-stayed holder 5 in order to support it in a correct and proper position on the axial line of a center electrode 4 and adjust spark gap 7 with the parallelism between the top of the grounded electrode and the top of the center electrode left unchanged.

Moreover, as shown in FIG. 6, it is further possible to support a grounded electrode 6 with a triple-stayed holder 5, the holder being provided with three stays apart from each other at an equal angular interval, whereby the diffusion rate of combustion gas is improved on the spark side and the formation of turbulence is more expected.

Figure 7:
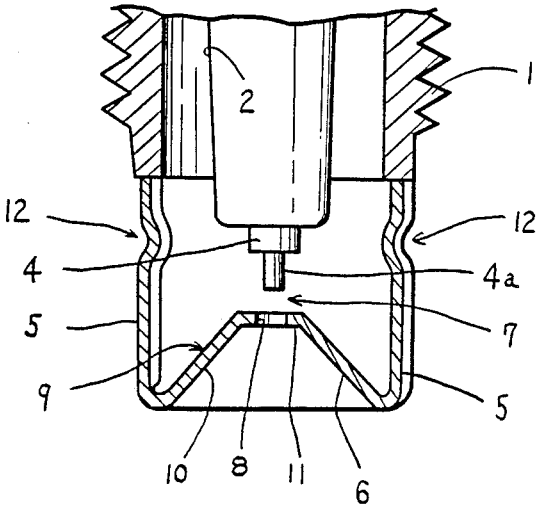
FIG. 7 is a cross-sectional side view of an essential part of a modified ignition plug of this invention.

Furthermore, FIG. 7 shows an example of a modified ignition plug of this invention, wherein placed on the top of a center electrode 4 is a cylindrical head 4a whose diameter is slightly smaller than a gas hole 8 having a genuinely circular form and spark gas 7 lies between the cylindrical head 4a and the opening of the gas hole 8. In place of the trumpet-shaped grounded electrode with interior concave surface 9 on the spark side and exterior convex surface 10 on the piston side shown in FIG. 1, a truncated conical grounded electrode is provided vis-a-vis with the center electrode 4 in order to increase the capacity to hold gas mixture on the piston side and to vary the combustion speed thereof in proportion to the interior inclination of the conical surface.

Figure 8:
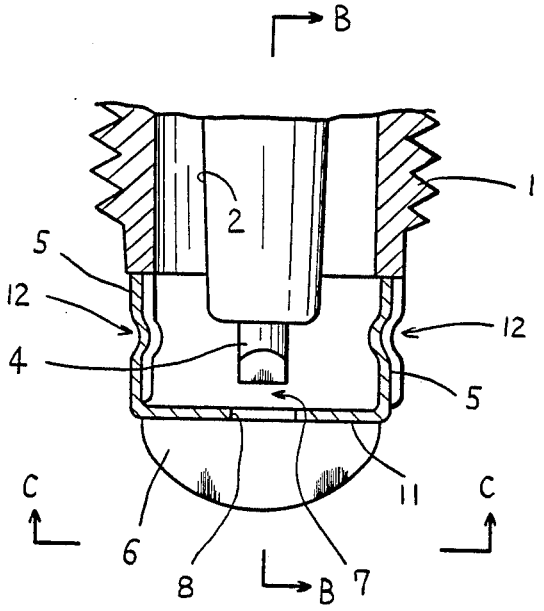
FIGS. 8, 9 and 10 are cross-sectional side views and plan view of an essential part of another modified ignition plug of this invention.
Figure 9:
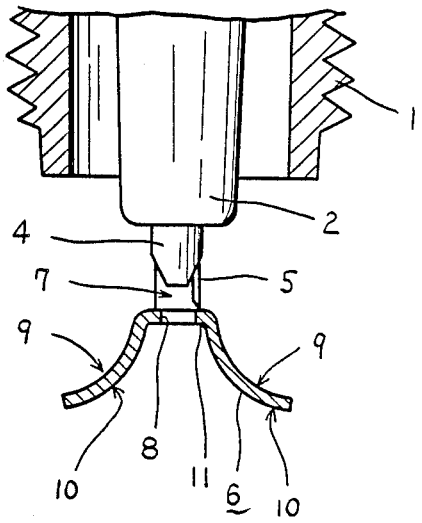
Figure 10:
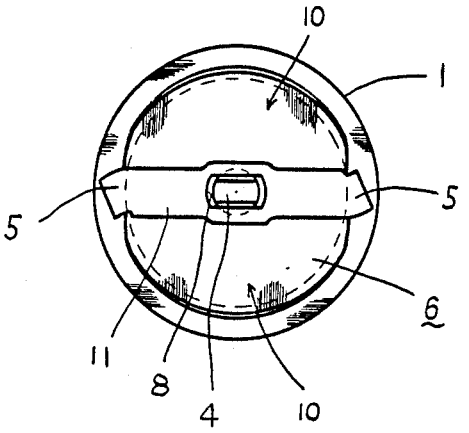

In addition to the above, FIGS. 8 to 10 show an example of another modified ignition plug of this invention with similar structure and different action. As clearly seen from the figures, a grounded electrode 6 is attached to an electroconductive metal casing 1 with a double-stayed holder 5 similarly as in the ignition plug shown in FIG. 5.

A saddleback roof-shaped grounded electrode 6 whose lower ends are made semi-circular, whose slope comprises steep and gentle curves, whose flat ridge extends up to the stays 5 on both sides so that there forms a gas-collecting re-entrant cavity 11 thereunder, and whose breadth is larger than the diameter of a center electrode 4 and smaller than the diameter of a insulating gasket 2 is provided face to face with the center electrode. A gas hole 8 pierced through the center of the flat ridge of the grounded electrode has an elongated circular form whose longitudinal axis is parallel to the longitudinal direction of the ridge and whose length is slightly larger than the diameter of the center electrode 4.

Spark formed between the center electrode 4 and the brim of the gas hole 8 ignites gas mixture in the gas-collecting re-entrant cavity just under the gas hole. Being relatively small in volume, the gas mixture lodging in the gas-collecting re-entrant cavity is set on fire in a moment. Expanding combustion gas resulting therefrom increases pressure, hindered by the exterior steep convex surface 10 on the piston side. The increased pressure prevails not only on the piston side but also on both sides of the gas-collecting re-entrant cavity 11; that is, it propagates along the longitudinal direction of the roof-shaped grounded electrode. On the other hand, the combustion gas is guided over the exterior gentle convex surface and rapidly increases its volume there, whereby the combustion gas diffuses in every direction in compliance with the semi-circular skirt of the grounded electrode. The pressure of the combustion gas prevailing such on the piston side that the gas mixture can be set on fire in a moment. On the spark side, the combustion gas likewise exerts pressure on the interior concave surface of the grounded electrode which strongly repels the combustion gas so as to diffuse and causes turbulence by that.

Figure 11:
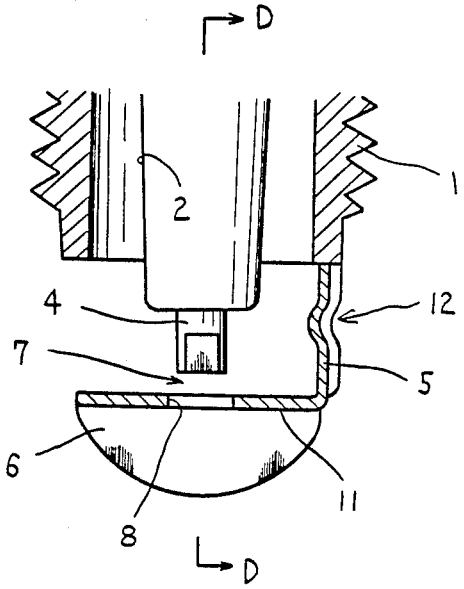
FIGS. 11 and 12 are cross-sectional side views of an essential part of still another modified ignition plug of this invention.
Figure 12:
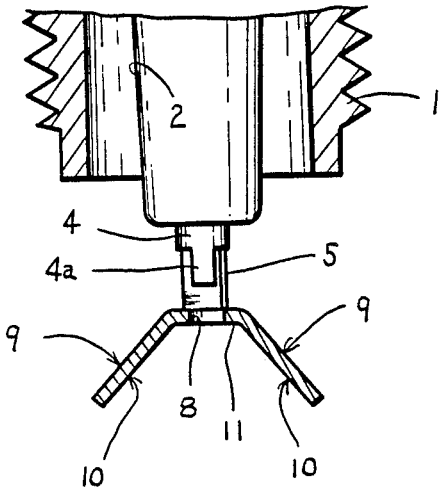

FIGS. 11 and 12 show an example of still another modified ignition plug of this invention. Whereas the grounded electrode of the former example has a concave surface on the spark side and a convex surface on the piston side, a grounded electrode of this example has a flat surface 9, 10 on both the spark and the piston sides. Its skirt is similarly made semi-circular and its gas hole 8 has an elongated circular form whose length is slightly larger than the diameter of a cylindrical head 4a on the center electrode 4 as shown in FIG. 10. The grounded electrode being formed into such a simple saddleback roof shape that it is very suitable for mass-production, which makes one of the advantages of this invention.

Figure 13:
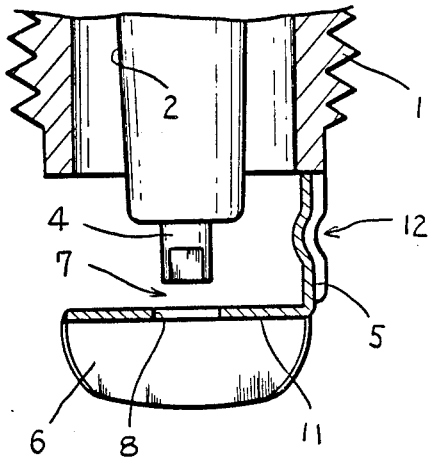
FIGS. 13, 14 and 15 are cross-sectional side views and plan view of an essential part of a fourth modified ignition plug of this invention.
Figure 14:
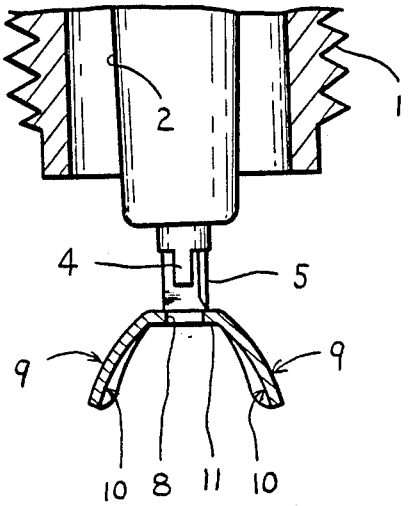
Figure 15:
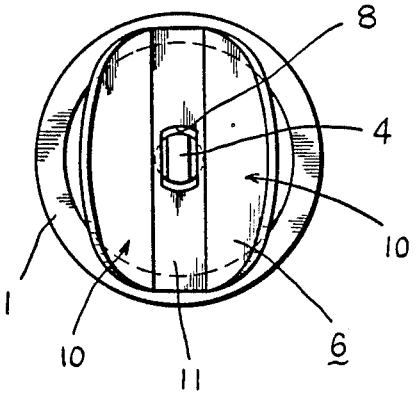

FIGS. 13 to 15 show an example of a fourth modified ignition plug of this invention, wherein a grounded electrode has a convex spherical surface on the spark side and a concave spherical surface on the piston side in order that much more gas mixture may be held by a gas-collecting re-entrant cavity 11 and expanding combustion gas may be repelled much more strongly so as to diffuse by the convex surface in compliance with the radius of curvature adopted. Thus, combustion gas is bounced on the convex surface on the spark side and gets into turbulence, which promotes the prevalence of gas combustion on the piston side as well.

As being apparent from the above examples, this invention is constructed of an ignition plug for internal combustion engines to cause instant combustion, characterized in that a hollow grounded electrode having a truncated conical form is disposed face to face with a center electrode in such a way that their respective axis falls on the same line and spark gap lies between the top of said center electrode and the top of said grounded electrode. On account of the conical surface spreading on both the piston and the spark sides, it is possible to spread combustion gas all around, with the result that combustion speed can be uniformed throughout the combustion chamber. In addition, the shape and size of the grounded electrode can be modified according to the displacement of engines, so that it is possible to improve the combustion gas turbulence and increase combustion speed very much, compared with conventional ignition plugs. In terms of the shape of the grounded electrode, it is also possible to minimize the volume of gas mixture to ignite first, accelerate combustion speed on the piston side and rapidly spread confined and pressurized combustion gas in a wide angle by the use of a trumpet-shaped grounded electrode with steep slope near the top and gentle slope near the bottom.

Likewise, it is possible to radiantly spread combustion gas in a swirling manner by the guide of twisted stays of a holder 5, which remarkably contributes to the formation of strong turbulence on the spark side and widely reduces the time before complete combustion; therefore, it also results in preventing unburned gas mixture from remaining in the combustion chamber.

The invention is also constructed of an ignition plug for internal combustion engines to cause instant combustion, characterized in that a grounded electrode having a saddleback roof form is disposed face to face with a center electrode in such a way that spark gap lies between the ridge of said grounded electrode and the top of the said center electrode and a re-entrant cavity for collecting gas mixture lies under the ridge of said grounded electrode, a gas hole pierced through the center of the ridge of said grounded electrode is placed opposite to said center electrode, and the lower end of said grounded electrode is made semi-circular in shape. Therefore, it is also possible to increase space on the piston side; as a result, the pressure of combustion gas and the combustion speed can be increased with ease much more.

Besides, the lower ends of the grounded electrode being made semi-circular in shape centering around the gas hole 8, combustion gas that bounced on the slope on the piston side almost uniformly and radiantly spreads throughout the combustion chamber. A gas-collecting re-entrant cavity 11 extending under the ridge of a grounded electrode where gas mixture can ignite the earliest possible because of the presence of a gas hole by spark between the center electrode 4 and the grounded electrode 6, the gas mixture can be burnt very uniformly in the space surrounded by the surfaces 10, 10 on the piston side. On account of the structure, it is possible to increase the pressure of combustion gas even in cylinders with large displacement with the increase in the space holding the gas mixture.

We claim:

1. An ignition plug for internal combustion engines to cause instant combustion, characterized in that a hollow grounded electrode having a truncated conical form is disposed face to face with a center electrode in such a way that their respective axis falls on the same line and spark gap lies between the top of said center electrode and the top of said grounded electrode and that at least one stay of a holder for connecting said grounded electrode to a casing of said center electrode is made flat and twisted.

2. An ignition plug for internal combustion engines to cause instant combustion, comprising: a grounded electrode having a saddleback roof form with a ridge at a narrow end and a bottom at a wider end, wherein said ridge is disposed face to face with a center electrode in such a way that the spark gap lies between the ridge of said grounded electrode and the top of said center electrode, wherein said bottom is disposed towards a piston, wherein a re-entrant cavity for collecting gas mixture lies under the ridge of said grounded electrode, wherein a gas hole pierced through the center of the ridge of said grounded electrode lies opposite to said center electrode, and wherein the lower end of said grounded electrode is semicircular in shape, said ignition plug further comprising a stay for connecting said grounded electrode to a casing for the ignition plug.

3. An ignition plug for internal combustion engines to cause instant combustion, comprising: A hollow grounded electrode having a truncated conical form with a top at a narrow end and a bottom at a wider end, said top having a gas hole located thereon, wherein said top is disposed face to face with a center electrode in such a way that the electrodes' respective axis falls on the same line and the spark gap lies between the top of said center electrode and the top of said grounded electrode, and wherein said bottom is disposed towards a piston, said ignition plug further comprising a stay for connecting said grounded electrode to a casing for the ignition plug.

4. The apparatus of claim 3 further comprising a casing for said center electrode, wherein said stay is connected to said casing of said center electrode.

5. The apparatus of claim 4 further comprising 4 stays for connecting said grounded electrode to said casing.

6. The apparatus of claim 5 wherein said stays are flat and twisted by a certain angle toward a same direction.

7. An ignition plug for internal combustion engines to cause instant combustion, comprising: a hollow grounded electrode having a truncated conical form with a top at a narrow end and a bottom at a wider end, said top having a gas hole located thereon, wherein said top is disposed face to face with a center electrode in such a way that the electrodes' respective axis falls on the same line and the spark plug gap lies between the top of said center electrode and the top of said grounded electrode, wherein said bottom is disposed towards a piston, and wherein said form has a slope near the top being steep and a slope near the bottom being gentle, said ignition plug further comprising a stay for connecting said grounded electrode to a casing for the ignition plug.

8. The apparatus of claim 7 further comprising a casing for said center electrode, wherein said stay is connected to said casing of said center electrode.

9. The apparatus of claim 8 further comprising 4 stays for connecting said grounded electrode to said casing.

10. The apparatus of claim 9 wherein said stays are flat and twisted by a certain angle toward a same direction.

11. An ignition plug for internal combustion engines to cause instant combustion, comprising: a grounded electrode having a saddleback roof form with a ridge at a narrow end and a bottom at a wider end, wherein said ridge is disposed face to face with a center electrode in such a way that the spark gap lies between the ridge of said grounded electrode and the top of said center electrode, wherein said bottom is disposed towards a piston, wherein a re-entrant cavity for collecting gas mixture lies under the ridge of said grounded electrode, wherein a gas hole extending through the center of the ridge of said grounded electrode lies opposite to said center electrode, and wherein the bottom of said grounded electrode is semi-circular in shape, said form of the grounded electrode further comprising flat sides extending between the ridge and the semi-circular lower end, whereby the grounded electrode has a flat spark side surface and a flat piston side surface, said ignition plug further comprising a stay for connecting said grounded electrode to a casing for the ignition plug.

12. An ignition plug for internal combustion engines to cause instant combustion, comprising: a grounded electrode having a saddleback roof form with a ridge at a narrow end and a bottom at a wider end, wherein said ridge is disposed face to face with a center electrode in such a way that the spark gap lies between the ridge of said grounded electrode and the top of said center electrode, wherein said bottom is disposed towards a piston, wherein a re-entrant cavity for collecting gas mixture lies under the ridge of said grounded electrode, wherein a gas hole extending through the center of the ridge of said grounded electrode lies opposite to said center electrode, and wherein the bottom of said grounded electrode is semi-circular in shape, said form of the grounded electrode further comprising curved sides extending between the ridge and the semi-circular lower end, whereby the grounded electrode has a convex spherical spark side surface and a concave spherical piston side surface, said ignition plug further comprising a stay for connecting the grounded electrode to a casing for the ignition plug.

13. An ignition plug for internal combustion engines to cause instant combustion, comprising: a grounded electrode having a saddleback roof form with a ridge at a narrow end and a bottom at a wider end, wherein said ridge is disposed face to face with a center electrode in such a way that the spark gap lies between the ridge of said grounded electrode and the top of said center electrode, wherein said bottom is disposed towards a piston, wherein a re-entrant cavity for collecting gas mixture lies under the ridge of said grounded electrode, wherein a gas hole extending through the center of the ridge of said grounded electrode lies opposite to said center electrode, and wherein the bottom of said grounded electrode is semi-circular in shape, said form of the grounded electrode further comprising curved sides extending between the ridge and the semi-circular lower end, whereby the grounded electrode has a concave spherical spark side surface and a convex spherical piston side surface, said ignition plug further comprising a stay for connecting the grounded electrode to a casing for the ignition plug.

* * * * *